United States Patent [19]

Ekkert et al.

[11] Patent Number: 4,957,211

[45] Date of Patent: Sep. 18, 1990

[54] VACUUM-INDICATING CLOSURE

[75] Inventors: Len Ekkert, Lemont; Charles A. Webster, Oak Lawn; Paul R. Hansen, Kildeer, all of Ill.

[73] Assignee: American National Can Company, Chicago, Ill.

[21] Appl. No.: 378,057

[22] Filed: Jul. 11, 1989

[51] Int. Cl.[5] ..... B65D 41/04

[52] U.S. Cl. ..... 215/230; 215/252; 215/270; 215/349

[58] Field of Search ..... 215/270, 271, 252, 349, 215/351, 230

[56] References Cited

U.S. PATENT DOCUMENTS

| | | | |
|---|---|---|---|
| 802,001 | 10/1905 | Lorenz | 215/270 |
| 933,347 | 9/1909 | Schmitt | 215/271 |
| 1,607,091 | 11/1926 | Lucas | 215/270 X |
| 1,696,330 | 12/1928 | Scofield | 215/270 X |
| 4,122,964 | 10/1978 | Morris | 215/349 X |
| 4,293,078 | 10/1981 | Percarpio et al. | 215/271 X |
| 4,616,761 | 10/1986 | Nolan | 215/271 |
| 4,658,976 | 4/1987 | Pohlenz | 215/349 X |
| 4,678,082 | 7/1987 | Fillmore | 215/271 X |
| 4,694,969 | 9/1987 | Granat | 215/252 |
| 4,799,598 | 1/1989 | McFadyen | 215/270 |
| 4,807,770 | 2/1989 | Barriac | 215/271 X |

FOREIGN PATENT DOCUMENTS

| | | | |
|---|---|---|---|
| 1177962 | 9/1964 | Fed. Rep. of Germany | 215/270 |
| 2313033 | 10/1973 | Fed. Rep. of Germany | 215/271 |

*Primary Examiner*—Stephen Marcus

*Attorney, Agent, or Firm*—Robert A. Stenzel; Daniel N. Christus

[57] ABSTRACT

A vacuum-indicating closure includes a top wall 12 and a skirt 14 depending from the periphery of the skirt with a tamper-evident band 24 formed on the lower edge of the skirt. The top wall has a center deflectable portion 30 formed by a thinned circumferential hinge 32 and the deflectable portion is divided into pie-shaped segments 44 by a plurality of radially-extending thinned hinged 40. The center deflectable portion is moved between a convex position and a concave position with the presence or absence of vacuum within the container to which it is applied.

5 Claims, 2 Drawing Sheets

VACUUM-INDICATING CLOSURE

TECHNICAL FIELD

The present invention relates generally to thermoplastic closures, and more particularly to closures for indicating the presence or absence of a vacuum in a container to which the closure is attached.

BACKGROUND ART

Many food products are required to be packaged in glass or plastic containers under a partial vacuum to prevent spoilage or to preserve flavor. It is important that a closure for such a container be able to properly seal the neck finish of the container to maintain the vacuum in the container until it is opened for consumption. It is also important to the packager to be able to visually inspect the container prior to shipment to ascertain whether the product contained in the container is still under sufficient amount of negative pressure.

Various closures have been proposed for indicating the presence or absence of a negative pressure in the container. For example, U.S. Pat. No. 2,194,004 discloses a metal closure used with hot filled products and indicates to the packager when the closure has been properly sealed and when all of the air has been removed. This is indicated by the closure being snapped from an upwardly-bowed position to a downwardly-bowed position.

U.S. Pat. Nos. 4,616,761 and 4,678,082 disclose thermoplastic closures which have central portions that are deflected to indicate the presence or absence of vacuum in the container to which the closure is sealed. This type of closure requires a significant amount of vacuum before the center button of the closure moves to a vacuum-indicating position.

However, the deflectable portion of the closure has only two positions and the portion which connects the deflectable portion to the periphery of the container is very small. Moreover, the connecting portion must also be deflected between two positions.

SUMMARY OF THE INVENTION

According to the present invention, a thermoplastic closure has been developed that readily indicates the presence or absence of vacuum within the container to which it is applied. The closure is designed to alert the packager when inadequate vacuum is present in the package so that the package can be discarded before shipment. The closure is designed for use at low-vacuum conditions, preferably on the order of 8 to 18 inches of mercury (HG) pressure.

More specifically, the closure of the present invention includes a top wall that is adapted to extend across the neck finish of a container and provide an air tight seal. A downwardly depending skirt extends from the periphery of the top wall and has threads or other securing means for securing the closure to the neck.

The vacuum-indicating means includes a center deflectable portion that is defined in the top wall by a thinned portion formed integral with the thermoplastic top wall. The center deflectable portion has radially-extending thinned portions defining hinges that divide the deflectable portion into pie-shaped segments.

Preferably, the top wall of the closure has a liner applied to the inner surface thereof and the liner is preferably secured to the top wall about its periphery, outside of the center deflectable portion and at the center of the deflectable portion so that the liner will not interfere with the flexing of the pie-shaped segments.

The closure preferably has a tamper-evident band associated therewith to indicate to the purchaser that the closure had been opened prior to purchase. The closure may also have a tamper-evident band of the type disclosed in U.S. Pat. No. 4,741,447. Alternatively, the tamper-evident band could be of the type disclosed in U.S. Pat. No. 4,546,892.

DETAILED DESCRIPTION

Figure 1:
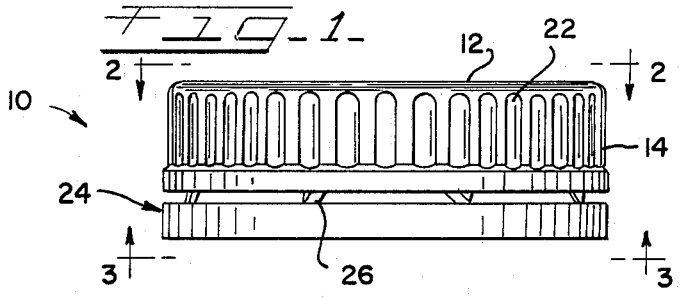
FIG. 1 discloses a side view of the closure of the present invention.
Figure 2:
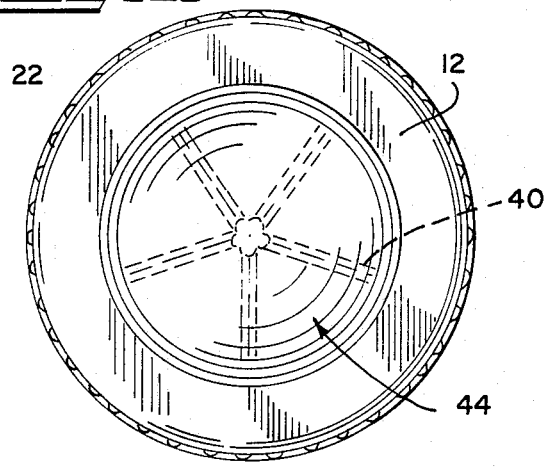
FIG. 2 is a top view of the closure, as viewed along line 2—2 of FIG. 1.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to embodiment illustrated.

The closure of the present invention is identified by reference number 10 in FIG. 1 and includes a generally circular top wall 12 and an annular skirt 14 depending from the periphery of the top wall, preferably being formed from a thermoplastic material having enhanced elastic memory. The annular skirt has internal threads 16 (FIG. 4) that cooperate with external threads 18 on the neck finish 20 of a container. The external surface of the skirt 12 may have ribs 22 formed thereon to provide a gripping surface during removal of the closure from the container.

The skirt preferably has a tamper-evident band 24 secured to the lower free edge thereof by a frangible connection 26. The tamper-evident band 24 cooperates with a bead 28 that is formed integral with the neck finish 20 of the container 21. The tamper-evident band is preferably of the type disclosed in U.S. Pat. No. 4,741,447, owned by the Assignee of the present invention and incorporated herein by reference.

According to the present invention, the top wall 12 of the closure 10 has vacuum-indicating means which will be described with reference to FIGS. 2–5. As illustrated in FIG. 5, the top wall 12 of closure 10 has a center deflectable portion 30 that is defined by a weakened or thinned portion 32. The thinned portion is preferably formed during the molding of the thermoplastic closure by forming a circumferential bead on each of the surfaces of the mold that are generally aligned with each other.

Thus, two generally opposed V-shaped grooves 34 and 36 are formed in opposite surfaces of the top wall 12. These grooves cooperate to define the thinned section 32 which produces a hinge between the center deflectable portion 30 and the peripheral portion 38 of the top wall which defines the sealing area for sealing with the top surface of the neck finish 20. The complimentary V-shaped grooves 34 and 36 cooperate with each other to reduce the amount of negative pressure required to cause the center deflectable portion to move. Moreover, the deflectable portion 30 is displaced upwardly from the plane P of the top wall 12 and is bowed upwardly in its natural position before being applied to the container.

Figure 3:
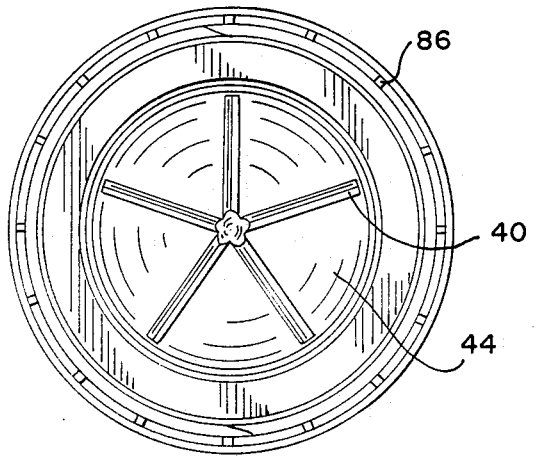
FIG. 3 is a bottom view of the closure, as viewed along line 3—3 of FIG. 1, with the liner deleted for purposes of clarity.
Figure 4:
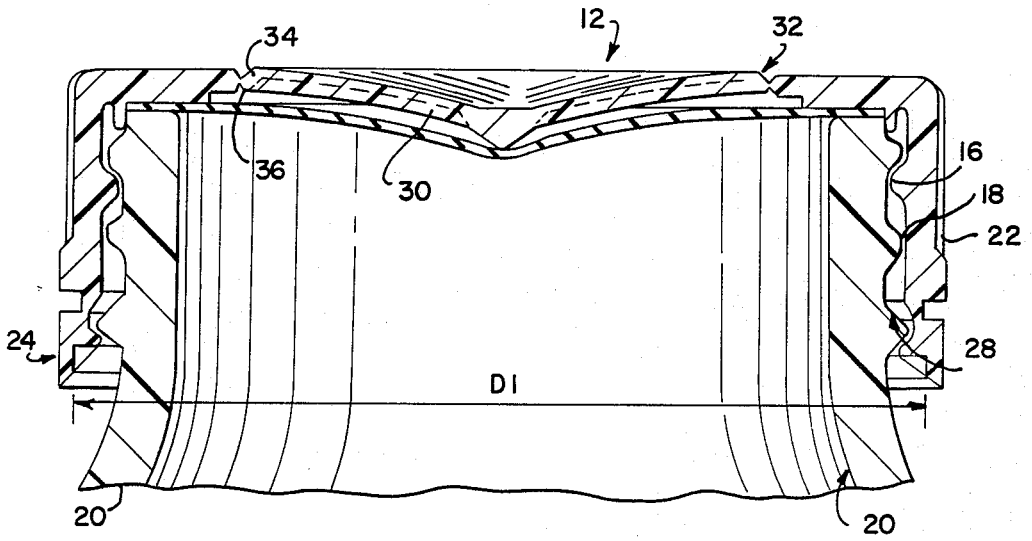
FIG. 4 is a cross-sectional view of the closure applied to a container having vacuum therein.
Figure 5:
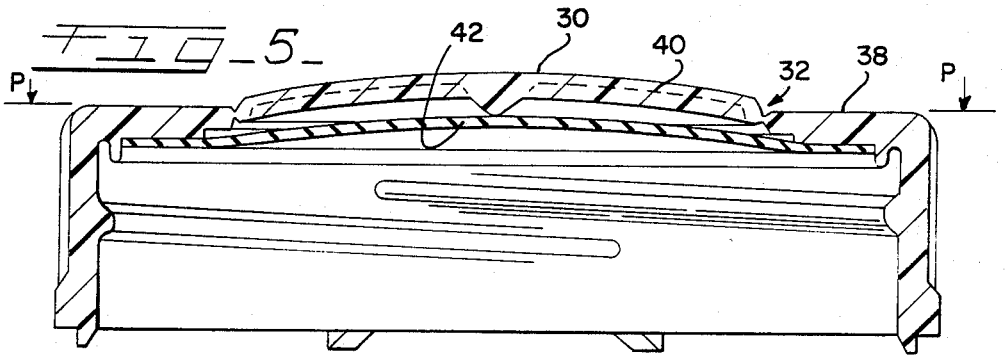
FIG. 5 is cross-sectional view of the closure before it is applied to the container.

According to the primary aspect of the present invention, the center deflectable portion has hinges defined therein which further enhances deflection of the deflectable portion from an upwardly-bowed condition illustrated in FIG. 5 to a downwardly-bowed condition illustrated in FIG. 4 in response to a vacuum or negative pressure in the container. As illustrated in FIG. 3, a plurality of radially-extending thinned portions 40 extend from a center thickened button 42 formed in the center of the deflectable portion 30 and define hinges between adjacent pie-shaped segments 44. It should be noted that the thinned portions 40 terminate inwardly of the circumferential hinge 32 and are generally V-shaped grooves molded into the top wall 12.

With the structure so far described, the closure is initially molded from a thermoplastic material and the hinges are integrally formed during the molding process. The finished molded structure is illustrated in FIG. 5 where it will be noted that the center deflectable portion is bowed-upwardly to a convex configuration when viewed from the inside of the container.

After the closure has been applied to the container and a seal is formed between the peripheral portion of the closure and the top surface of the neck finish, a vacuum produced in the container will snap the deflectable portion or button from the position illustrated in FIG. 5 to that illustrated in FIG. 4. During the snapping of the deflectable portion 30 from a convex condition to a concave condition, as viewed from the inside of the container, the thermoplastic hinge areas and the deflectable portion are placed under compression.

The configuration of the closure, particularly the hinges, results in the reversal of the button at minimum negative pressures, which is as little as 8 inches HG. Moreover, if the vacuum is no longer present in the container during processing by the packager, the structurally-built-in elastic memory will aid in moving the center portion 30 to its convex position.

According to one further aspect of the invention, an oxygen barrier liner is preferably secured to the inner surface of the closure. Thus, as illustrated in FIG. 5, a foil liner 50 is introduced into the closure and is secured, as by sonic welding, to the bottom surface of the top wall about its periphery, outside the circumferential hinge 32. Thus, the liner will not interfere with the operation of the vacuum-indicating means. If desired, the liner may also be secured, as by sonic welding to the center button 42, but is not secured to the remainder of the deflectable portion 30. Alternative means of securing the liner could be heat-staking, induction welding or pressure-sensitive adhesive.

In addition to the liner, the closure may have an integral sealing means formed as part of the bottom surface of the top wall of the closure. This sealing means may be of the type illustrated in U. S. Pat. No. 4,741,447.

Figure 6:
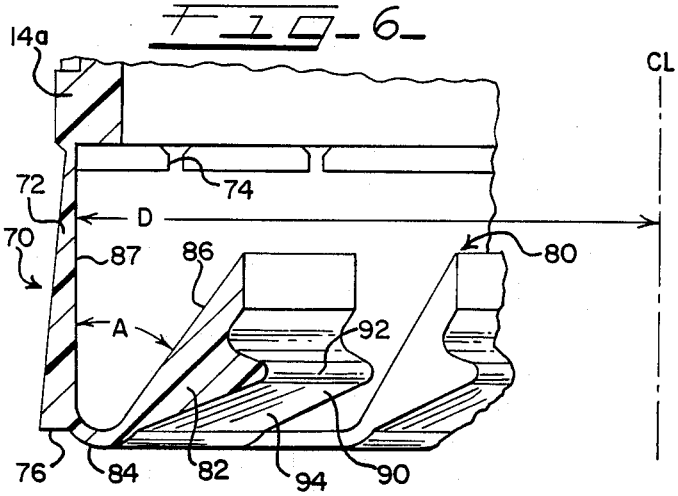
FIG. 6 is a fragmentary view of a modified form of tamper-evident band; and, FIG. 7 is a cross-sectional view showing the modified tamper-evident band on the container.

A slightly modified form of tamper-evident band is disclosed in FIG. 6, and to some extent follows the teachings of U.S. Pat. No. 4,546,892. As disclosed therein, the tamper-evident band is generally designated by reference numeral 70 and includes a circumferential band 72 that is secured to the lower edge of the skirt 14*a* through a plurality of frangible connections 74. The band 72 has an increasing thickness or is tapered from the upper edge thereof to the lower edge, which is identified by reference numeral 76.

According to the present aspect of this invention, a plurality of circumferentially-spaced locking tabs 80 are formed integral with the inner lower edge 76 of the band 72. Each of the tabs consists of a main body 82 that is connected to the lower edge of the band through an arcuate integral hinge 84. The inner surface 86 of the body 82 of the tab 80 defines an included angle A with respect to the inner surface 87 of the band 72. This angle can range from the order of about 25° to about 65°.

Each of the tabs 80 has a triangular, generally enlarged portion 90 extending from a surface of the main body 82 adjacent the lower end thereof to define a generally flat engaging surface 92. The enlarged portion 90 also has a camming surface 94 extending from the lower edge thereof. Each of the tabs is preferably molded integral with the band 72 and is molded in situ in the position illustrated in FIG. 6.

The inner surface of the band 72 defines an annular ring which has a diameter D that is greater than the diameter D1 of the outer edge of the bead 28 on the neck finish 20 of the container.

Figure 7:
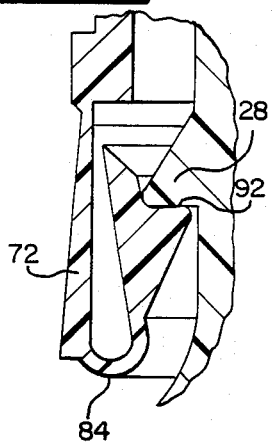

In assembling the closure onto the container, the threads 16 of the closure engage the thread 18 on the neck finish which will move the tabs 80 toward the bead 28. The camming surfaces 94 on the tangs or tabs 80 will cause the tabs to deflect about the hinge 84 toward the surface 87 of the band 72. When the flat abutment 92 moves past the outer edge of the bead 28, the elastic memory of the thermoplastic material will move the tabs 80 away from surface 87 to produce extended surface contact with the lower surface of the bead 28, as shown in FIG. 7. For this purpose, the lower surface of the bead 28 and the abutment surface 92 extend parallel to each other when the closure is in sealing engagement on the neck finish. Preferably, these surfaces extend substantially perpendicular to the main body 82, more specifically surface 86.

When the closure is removed, the abutment surface 92 will prevent the tamper-evident band from being removed and the rotation of the closure will severe the tangs 74 so that the tamper-evident band will remain on the container. The tamper-evident band is desirable since the center button will, most times, not pop up after prolonged periods of storage because of the plastic materials tending to set in the down position and the small negative operating pressures.

Numerous modifications come to mind without departing from the spirit of the invention. For example, while five radial hinges have been shown, a greater or lesser number of hinges could be utilized. Also, any number of tabs may be provided, dependent on the closure application.

While the specific embodiments have been illustrated and described, numerous modifications come to mind without significantly departing from the spirit of the invention and the scope of protection is only limited by the scope of the accompanying claims.

We claim:

1. A vacuum-indicating closure comprising a top wall adapted to extend across and provide a seal for neck finish of a container and a skirt extending downwardly from a periphery of said top wall and having a member for securing said closure, the improvement comprising means defining a deflectable center portion in said top wall, said deflectable center portion having radially-extending thinned portions to divide said center portion into segments joined to each other by said thinned portions so that said center portion moves between a generally outward convex configuration to a generally concave configuration depending upon the presence or absence of vacuum in the container.

2. A closure as defined in claim 1, in which said means includes a circumferential thinned portion spaced inwardly of the periphery of said top wall.

3. A closure as defined in claim 1, and further including tamper-indicating means attached to a lower edge of said skirt.

4. A closure as defined in claim 1, further including a liner applied to the inner surface of said top wall.

5. A closure as defined in claim 4, in which said liner is secured to said inner surface along the peripheral portion thereof.

* * * * *

UNITED STATES PATENT AND TRADEMARK OFFICE

CERTIFICATE OF CORRECTION

PATENT NO. : 4,957,211

DATED : September 18, 1990

INVENTOR(S) : Ekkert et al.

It is certified that error appears in the above-identified patent and that said Letters Patent is hereby corrected as shown below:

Abstract, Line 7, delete "hinged" and insert --hinges--.

Column 4, Line 50, delete "severe" and insert --sever--.

Signed and Sealed this

Eleventh Day of February, 1992

*Attest:*

HARRY F. MANBECK, JR.

*Attesting Officer*

*Commissioner of Patents and Trademarks*